US005181636A

United States Patent [19]

Anderson et al.

[11] Patent Number: 5,181,636

[45] Date of Patent: Jan. 26, 1993

[54] INCREMENTAL DISPENSING DEVICE

[75] Inventors: J. Edward C. Anderson, Moreland Hills; James R. Jeromson, Jr., Aurora, both of Ohio

[73] Assignee: Milbar Corporation, Chagrin Falls, Ohio

[21] Appl. No.: 627,845

[22] Filed: Dec. 14, 1990

[51] Int. Cl.[5] ..... B67D 5/42

[52] U.S. Cl. ..... 222/389; 222/391

[58] Field of Search ..... 222/1, 323-327, 222/389, 391, 340

[56] References Cited

U.S. PATENT DOCUMENTS

| | | | |
|---|---|---|---|
| 2,726,802 | 12/1955 | Jones | 226/125 |
| 3,381,861 | 5/1968 | Stein | 222/256 |
| 3,402,847 | 9/1968 | Downing | 222/327 |
| 3,439,839 | 4/1969 | Schumann et al. | 222/95 |
| 3,768,472 | 10/1973 | Hodosh et al. | 222/389 |
| 3,980,209 | 9/1976 | Collar | 222/323 |
| 3,983,947 | 10/1976 | Wills et al. | 173/169 |
| 4,081,112 | 3/1978 | Chang | 222/391 |
| 4,174,068 | 11/1979 | Rudolph | 222/327 |
| 4,376,498 | 3/1983 | Davis, Jr. | 222/326 |
| 4,441,629 | 4/1984 | Mackal | 222/324 |
| 4,570,832 | 2/1986 | Kroger | 222/325 |
| 4,653,673 | 3/1987 | Wagner | 222/327 |
| 4,826,050 | 5/1989 | Murphy et al. | 222/334 |
| 4,925,061 | 5/1990 | Jeromson, Jr. et al. | 222/1 |
| 4,966,317 | 10/1990 | Barr | 222/5 |

FOREIGN PATENT DOCUMENTS

| | | |
|---|---|---|
| 8909425 | 11/1989 | Fed. Rep. of Germany . |
| 2424856 | 11/1979 | France . |

OTHER PUBLICATIONS

Vital Products, Inc. Specification Sheet, Model AA-Air-Lite.

Vital Products, Inc. Specification Sheet, Model DAC-Air-Lite, Jr.

Kenmar Specification, Model No. 75A.

*Primary Examiner*—Andres Kashnikow

*Assistant Examiner*—Philippe Derakshani

*Attorney, Agent, or Firm*—Calfee, Halter & Griswold

[57] ABSTRACT

A fluid actuated dispensing device having a valve assembly and an actuating piston provides incremental movement of a drive piston within a tube holder. The valve assembly includes a trigger piston and a valve ball biased into engagement with a valve seat. A trigger is adapted to engage the trigger piston and urge the valve ball away from its seat to allow fluid to enter an actuating chamber. The increase in fluid pressure within the chamber drives an actuating piston from an initial position to an extended position in the chamber. The actuating piston is adapted to drive a washer off-center against a push rod during the stroke of the actuating piston. The washer cocks and grabs the push rod and urges the rod forwardly within the tube holder. A drive piston connected to the push rod is thereby driven forward within the tube holder for the full stroke of the actuating piston. When the trigger is released, the fluid in the actuating chamber is exhausted through a passage in the trigger piston, which thereby reduces the pressure in the actuating chamber. The reduced pressure in the chamber allows a spring to uncock the washer and bias the washer and the actuating piston back into their initial positions, which provides for incremental movement of the push rod, and hence the drive position.

27 Claims, 9 Drawing Sheets

INCREMENTAL DISPENSING DEVICE

TECHNICAL FIELD

The present invention relates to a fluid actuated dispensing device having a valve assembly and actuating piston designed to provide incremental movement of a drive piston within a tube holder.

BACKGROUND OF THE INVENTION

Manually operated caulking guns have been designed for dispensing caulking compounds and other viscous or plastic material from disposable tubes. The caulking guns typically include a trigger mechanism which forces a drive piston on a push rod against a piston in the tube to dispense the selected quantity of caulking compound or other material.

One such manual caulking gun is manufactured by the COX Company under the tradename WEXFORD. The trigger mechanism in the COX gun includes a hand grip die-cast with a frame, and a trigger pivotally connected to the frame. The trigger is adapted to be pivoted towards the grip, which forces a flange on the trigger to drive a washer on a push rod off-center. The washer cocks and grabs the push rod, thereby urging the push rod forwardly within a tube holder. A drive piston connected to the push rod is thereby forced against the end of a tube in the tube holder to dispense the viscous or plastic material. At the end of the trigger stroke, the trigger is released, and a spring uncocks the washer and biases the washer and the trigger back into their initial position, while a locking lever prevents the push rod from moving rearwardly.

Conventional replaceable tubes for caulking compounds and other viscous or plastic material include a casing, a tube cap, and a plastic tube piston which together define a cavity for the material. The tube piston is adapted to be urged against the material and dispense the material through a nozzle over the cap. Tubes typically contain about 10 fluid oz. of material, but other sizes, such as 30 fluid oz., are available. The tubes are disposable and are designed to be replaced when exhausted, as compared to bulk caulking guns which have a dispensing chamber adapted to be filled directly with the viscous or plastic material. A typical replaceable tube designed for caulking compound is manufactured by The Glidden Company under the tradename MACCO Adhesives.

Other dispensers for caulking compounds or other material use compressed air instead of a manually applied force to dispense the material from the tube. The compressed air reduces the manual effort necessary to dispense the material. For example, Wills et al, U.S. Pat. No. 3,983,947, discloses a caulking gun having a push rod in a chamber urged forwardly by compressed air entering the rear of the chamber. A trigger is adapted to urge a valve ball out of its seat within a valve chamber to allow the compressed air to flow around the valve ball and into the piston chamber.

Similarly, Collar, U.S. Pat. No. 3,980,209, discloses a caulking gun for bulk dispensing of plastic or viscous material, wherein a piston in a forward barrel is connected by a shaft to a piston in a rear barrel. During dispensing of the material, a trigger is adapted to engage a trigger piston and allow compressed air to flow through an air passage to the rear of the forward barrel. The compressed air forces the forward piston against the material, which is thereby dispensed through a nozzle in the caulking gun.

Additionally, Mackal, U.S. Pat. No. 4,441,629, discloses a caulking gun wherein a $CO_2$ cartridge supplies compressed gas through a valve assembly to the rear portion of the caulking gun cylinder. The compressed gas is forced against the caulking tube piston, which thereby applies pressure to the caulking compound and dispenses the compound through the caulking tube nozzle.

These caulking guns however, are not without drawbacks. For example, when compressed air or gas is applied directly against the piston of the caulking tube, the piston has a tendency to tilt, and the compressed air or gas can leak around the piston and channel through the caulking compound. The channeling causes sputtering at the nozzle of the caulking tube and a degradation of the caulking product.

Moreover, compressed air from an air compressor is relatively inexpensive when compared to compressed gas from a $CO_2$ cartridge. Accordingly, caulking guns using compressed air from a compressor can more readily afford to exhaust a good portion of the air during use, such as through the movement of valves and leaks in the valve assembly.

However, using a dispensing device with the more portable, but relatively more expensive liquid $CO_2$ cartridge presents some important economic considerations. In particular, each $CO_2$ cartridge contains a limited amount of liquid $CO_2$. The gas which is produced from the liquid $CO_2$ must therefor be used as efficiently as possible for dispensing the viscous or plastic material.

SUMMARY OF THE INVENTION

The present invention provides a new and useful dispensing device for dispensing a caulking compound or other viscous or plastic material. The dispensing device is designed to incrementally dispense the material from a disposable tube. The dispensing device includes a tube holder adapted to receive the tube, and a push rod having a drive piston adapted to engage the tube piston to dispense the viscous or plastic material.

The push rod is urged against the tube piston by an actuating piston. The actuating piston is adapted to engage a portion of a washer surrounding the push rod, and drive the washer off-center against the rod. The washer cocks and grabs the rod to force the rod, and hence the drive piston against the tube piston.

According to one aspect of the invention, the actuating piston is disposed within an actuating chamber in a pressure regulating assembly. The pressure regulating assembly also includes a valve assembly having a trigger piston and a valve ball biased by a first spring and gas pressure into engagement with a valve seat.

A trigger is adapted to engage the trigger piston and urge the valve ball out of engagement with the valve seat, to thereby allow compressed gas to flow into the rear of the actuating chamber. The increase in gas pressure in the rear of the chamber drives the actuating piston from an initial position to an extended position in the chamber. The actuating piston drives the washer off-center against the push rod during the stroke of the actuating piston.

When the trigger is released, the valve ball is biased back into engagement with the valve seat by gas pressure and the first spring, and an exhaust passage is opened in the trigger piston. The gas in the actuating chamber flows out the exhaust passage and reduces the pressure in the actuating chamber. The reduced pressure in the actuating chamber allows a second spring to uncock the washer and bias the washer and the actuating piston back into their original positions.

According to another aspect of the invention, the dispensing device includes an actuating piston mounted co-axially with a push rod in an actuating chamber. Compressed air entering the rear of the actuating chamber increases the pressure in the chamber and forces the actuating piston forwardly to engage and move a drive washer. Releasing the trigger opens an exhaust passage connected to the front of the actuating chamber. The compressed air in the rear of the chamber flows out the exhaust passage and into the front of the chamber, which reduces the pressure in the rear of the chamber and allows the washer and the actuating piston to be biased back into their original positions.

According to yet another aspect of the invention, the dispensing device includes a pair of valve assemblies adapted to apply a variable load against the drive washer, depending on the viscosity of the product. The amount of load applied to the drive washer is selectable with a ramp switch.

One useful feature of the invention is that the compressed air or gas is not applied directly to the plastic tube piston. The compressed gas therefor cannot leak around the piston and channel through the viscous or plastic material to cause sputtering at the nozzle and degradation of the material. Moreover, the drive piston on the push rod keeps the tube piston from tilting in the tube during operation.

Another useful feature of the invention is that the exhaust passage in the trigger piston reduces the pressure within the actuating chamber after each stroke of the trigger. The reduced pressure in the chamber allows the actuating piston and drive washer to be biased back to their initial positions after each trigger pull. This feature allows incremental movement of the push rod against the tube piston to dispense the viscous or plastic material.

Moreover, another useful feature is that the structure of the valves and pistons within the dispensing device minimizes the amount of compressed gas necessary to dispense the plastic or viscous material, and reduces the amount of gas that is exhausted or leaked during dispensing. This feature accordingly improves the economic qualities of the dispensing device.

Yet another feature of the invention is that the force that the drive piston on the push rod applies to the tube piston is variable, and can be selected depending on the viscosity of the material.

Further features and advantages of the present invention will become apparent when the following detailed description and the accompanying drawings.

DETAILED DESCRIPTION OF THE PREFERRED EMBODIMENT

As described above, the present invention relates to a fluid actuated dispensing device which provides for incremental movement of a drive piston within a tube holder. The dispensing device preferably uses disposable tubes of caulking compound or other viscous or plastic material, but the same principles can also apply to dispensing devices designed for the bulk dispensing of these viscous or plastic materials.

Figures 1, 1A:
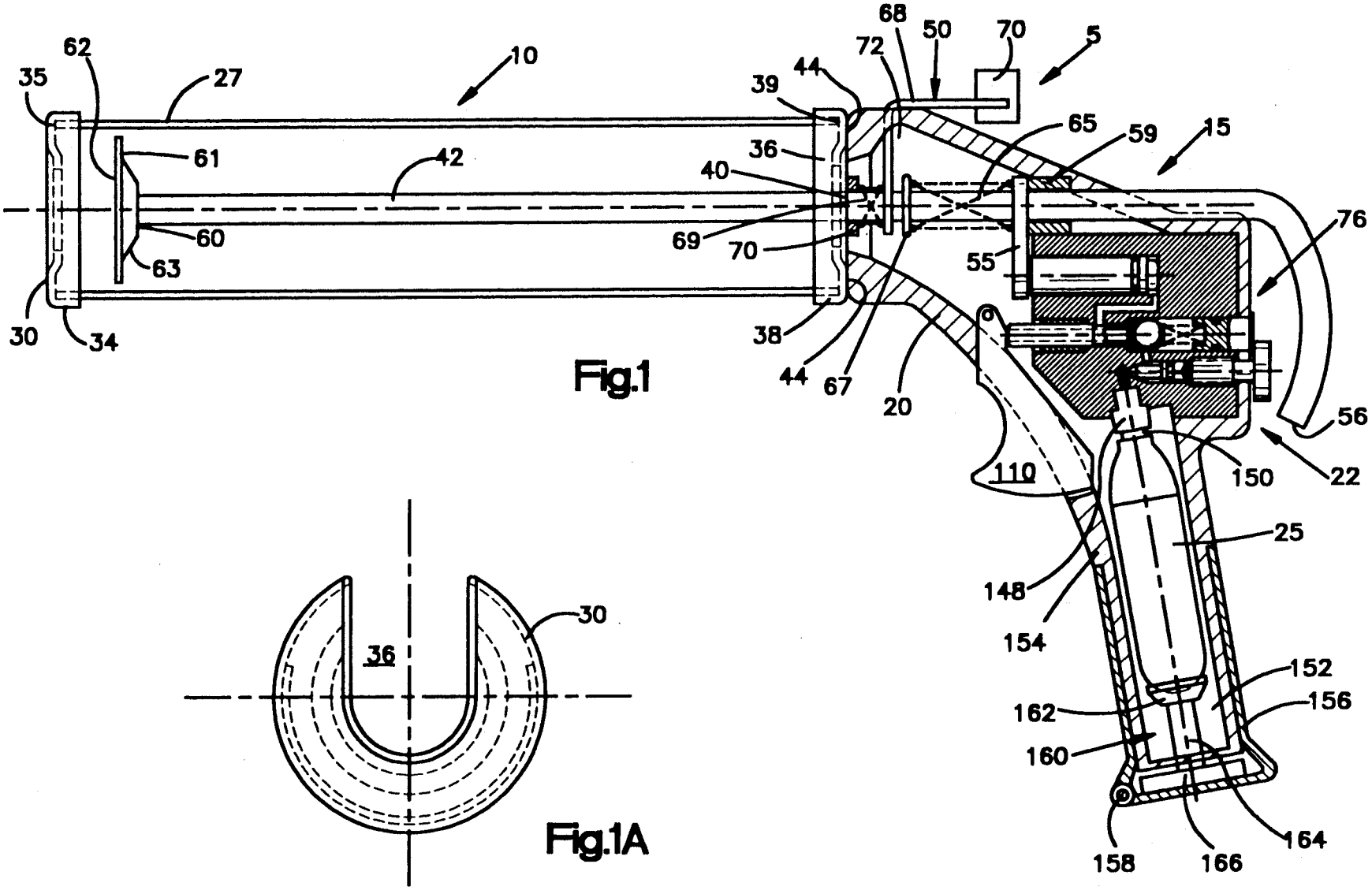
FIG. 1 is a side elevation view of a dispensing device constructed according to the present invention, shown in partial section.
FIG. 1A is an enlarged sectional view of an end piece of the dispensing device.

As shown in FIG. 1, a dispensing device, indicated generally at 5, includes a tube holder, indicated generally at 10, a drive assembly, indicated generally at 15, and a housing 20. The housing 20 encloses a pressure regulating assembly, indicated generally at 22, a gas source 25, and partially encloses the drive assembly 15.

The drive assembly 15, pressure regulating assembly 22 and gas source 25 are adapted to provide for the incremental dispensing of a caulking compound or other viscous or plastic material from a replaceable tube (not shown) located in the tube holder 10. The tube holder 10 and the drive assembly 15 are conventional in design and can be formed substantially as shown in the caulking gun manufactured by the COX Company under the trademark WEXFORD.

A variety of disposable tubes can be used in the present invention, such as for example, a disposable caulking tube manufactured by The Glidden Company under the tradename MACCO Adhesives. The tubes preferably contain about 10 fluid oz. of caulking compound, however, other size tubes, such as 30 fluid oz., can also be used with the present invention. Moreover, although this invention is primarily directed towards tubes containing caulking compound, the dispensing device can also be used to dispense other viscous or plastic materials from tubes, such as for example, butyl rubber, silicone, latex, mortar seal, roof cement, or other such adhesives or sealants.

A typical caulking tube includes an annular wall defining a bore, a cap having a nozzle attached to one end of the tube, and a caulking tube piston located within the annular wall at the other end of the tube. The cap, wall and piston define a cavity for the caulking compound. The caulking tube piston is adapted to slide within the bore formed by the walls of the caulking tube and apply pressure to the caulking product to dispense the product from the nozzle of the tube.

The caulking tube is inserted into a steel or aluminum tube holder 10 in the dispensing device in a conventional manner. In particular, the tube is inserted into the holder 10 such that the tube nozzle contacts and is aligned by an aperture 36 (FIG. 1A) formed in a first end piece 30 of the tube holder 10. The first end piece 30 includes an annular flange 34 extending outwardly therefrom which is adapted to be soldered or otherwise attached to a first, or forward end 35 of the tube holder 10.

The tube holder 10 further includes a second end piece 36 having an annular flange 38 attached to a second, or rear end 39 of the holder 10. The second end piece 36 includes a central aperture 40 adapted to allow relative axial movement of a push rod 42, as described herein in more detail. The second end piece 36, and hence the tube holder 10, are attached to the housing 20 by spot welding, such as, for example, as shown at 44.

The push rod 42 forms part of the drive assembly 15. The drive assembly 15 further includes a locking assembly, indicated generally at 50, and a drive washer 55. The push rod 42 is preferably hexagonal in cross section, although the rod may have other cross-sectional configurations, such as a circular or square configuration. The rear end 56 of the rod 42 is bent downwardly to facilitate manually grasping the rod 42. The push rod 42 extends through a rod guide 59 attached to the housing 20, and through the aperture 40 formed in the second end piece 36 of the tube holder 10.

The forward end 60 of the push rod 42 is connected to the rear surface of a conventional drive piston 61. The drive piston 61 has a front surface 62 which has a flat outer periphery, and a cup-shaped inner portion 63 which is attached to the push rod 42. The drive piston 61 is similar in surface area to and is adapted to engage the piston in the caulking tube.

The drive washer 55 is normally rearwardly biased by a first spring 65. The spring 65 is received around the push rod 42 and extends between a frame member 67 attached to the housing 20, and the drive washer 55. The spring 65 biases the drive washer 55 against the rod guide 59. The drive washer 55 is eccentrically loaded, as described herein in more detail, which causes it to cock and grab the push rod 42. The cocked washer is adapted to move the push rod 42 forwardly against the spring bias, and hence move the drive piston 42 forwardly within the tube holder 10.

The locking assembly 50 includes a conventional looking lever 68 to restrict the rearward movement of the push rod 42. To this end, a second spring 69 is received around the push rod 42 and extends between the locking lever 68 and a bushing 70 attached to frame 36. The locking lever 68 includes a knob 71 and is formed in a L-shaped design around a pin 72 attached to housing 20.

As in conventional manual caulking guns, the locking lever 68 is adapted to cock during rearward movement of the push rod 42 and grab and retain the push rod 42. Moreover, the locking lever 68 is adapted to allow forward progress of the push rod 42 without cocking but the knob 71 on the locking lever 68 must be pushed downwardly to release the locking function of the lever and allow rearward movement of the push rod 42, such as when a caulking tube is initially being inserted or replaced.

Figure 2:
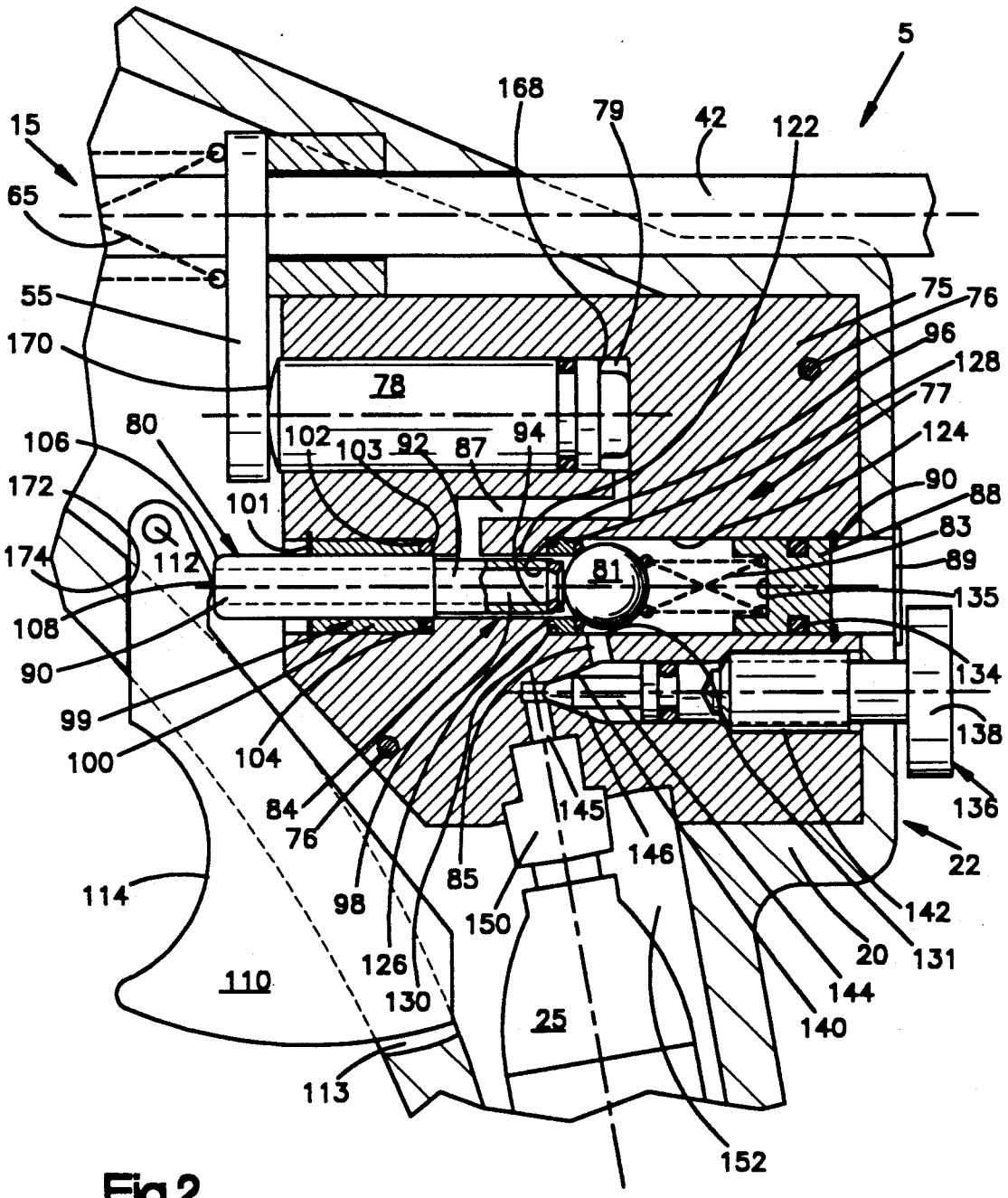
FIG. 2 is an enlarged sectional view of the dispensing device of FIG. 1, showing the pressure regulating assembly in an initial position.

As shown more clearly in FIG. 2, the pressure regulating assembly 22 includes a body 75 formed from aluminum or other suitable material, and drilled or tapped to form bores and apertures for valves, pistons and valve balls. The body 75 is mounted to the housing 20 with conventional screws or bolts 76.

The pressure regulating assembly 22 of the dispensing device is adapted to apply an eccentric off-center load against the drive washer 55 and thereby incrementally move the push rod 42, and hence the drive piston 61 (FIG. 1), within the dispensing device. To this end, the pressure regulating assembly 22 includes a valve assembly, indicated generally at 77, adapted to allow fluid from the compressed gas source 25 to be applied to a nylon actuating piston 78 in an actuating chamber 79.

The valve assembly 77 includes a trigger piston, indicated generally at 80, a steel valve ball 81, and a spring 83, which are adapted to control the flow of fluid from a first passage 85 to a second passage 87. The trigger piston 80, valve ball 81 and spring 83 are at least partially received within a valve chamber, indicated generally at 84. The valve chamber 84 extends through the body 75 and is closed at one end by a spring cup 88 secured to the body 75 by a retaining plate 89 and a retaining ring 90.

The trigger piston 80 is formed from steel or other suitable material and includes a body 90 and a thinner, necked portion 92. The end 94 of necked portion 92 includes a rubber ring 96 bonded thereto. The ring 96 is adapted to engage and seal against the valve ball 81 when the trigger piston 80 is forced against the ball 81. The trigger piston 80 further includes an exhaust passage 98 formed axially through the body 90 and the necked portion 92. The rubber ring 96 substantially surrounds the opening to the exhaust passage 98 in end 94.

The trigger piston 80 is partially received within a first section, indicated generally at 99, in the valve chamber 84. The first section 99 includes a sleeve 100 that surrounds the trigger piston 80. The sleeve 100 is secured within the first section 99 by a retaining ring 101. The first end 102 of the sleeve 100 and an inwardly extending shoulder portion 103 in the first section 99 form a recess (not numbered). A conventional rubber O-ring 104 is included within the recess to prevent the flow of compressed gas between the body 90 of the trigger piston 80 and the sleeve 100.

Figure 3:
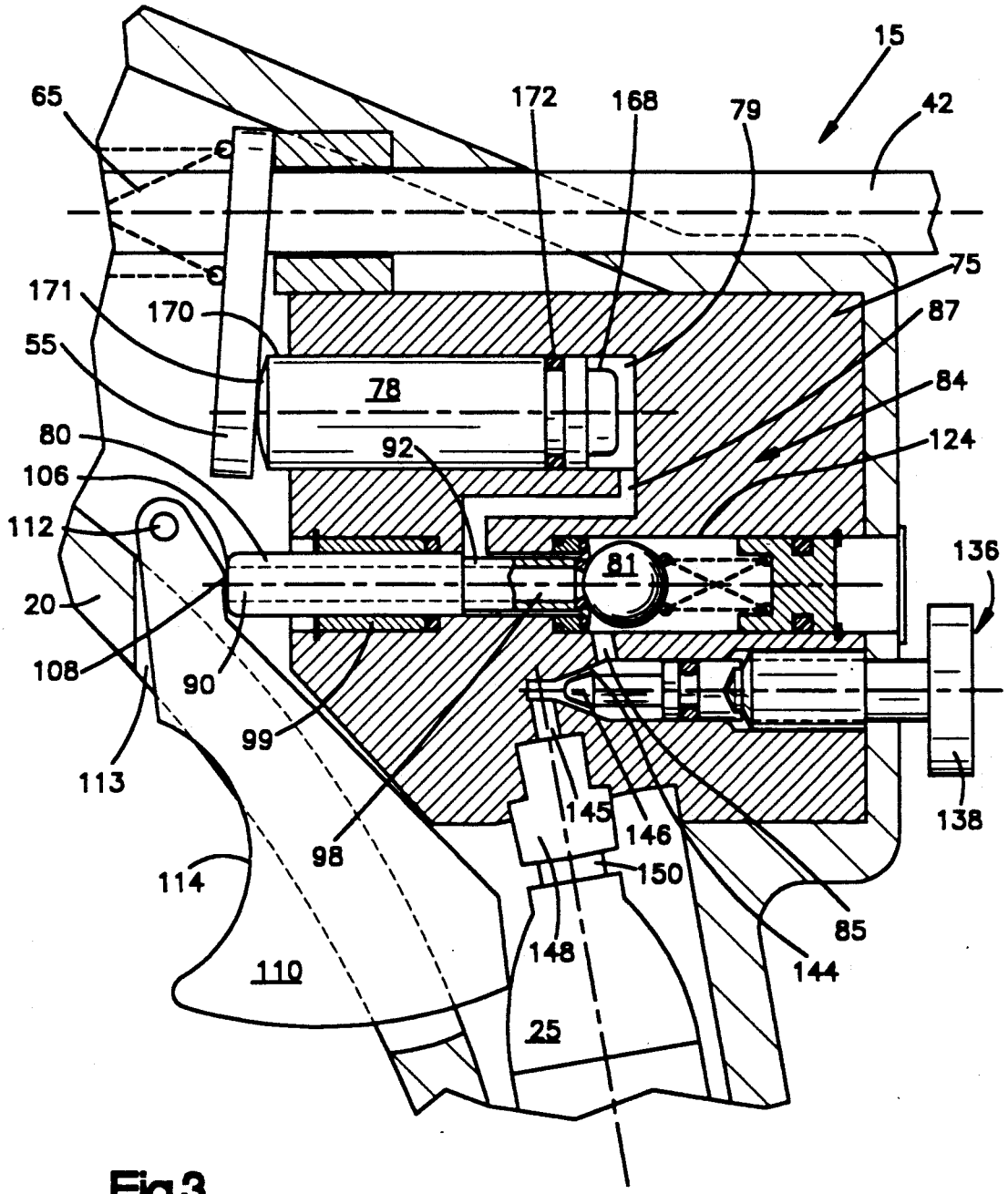
FIG. 3 is as enlarged sectional view of the dispensing device of FIG. 1, showing the pressure regulating assembly in an extended position.

The body 90 of the trigger piston 80 includes a second end 106 which is adapted to be engaged by an abutment 108 on a trigger 110, for example as shown in FIG. 3. The trigger 110 is pivotally connected to the housing 20 by a pin 112, and extends partially through an aperture 113 formed in housing 20. The trigger is adapted to be urged against the trigger piston 80. In particular, manual force is preferably applied to a cup-shaped portion 114 of the trigger 110, which pivots the trigger 110 around the pin 112 and forces the abutment 108 into engaging relationship with the end 106 of the trigger piston 80.

Referring again to FIG. 2, the first section 99 of the valve chamber 84 narrows at the shoulder portion 103 to a necked section 122 which is slightly larger in diameter than the necked portion 92 of the trigger piston 80. The necked section 122 is designed to allow compressed gas to flow between the necked portion 92 of the trigger piston 80 and the inside walls of the necked section 122.

The second passage 87 connects necked section 122 with the rear of the actuating chamber 79.

The necked section 122 of the valve chamber 84 widens to a second section, indicated generally at 124, and includes a second shoulder portion 126. An annular molded insert 128 is inserted within the second section 124 and traps an O-ring 130 between the inside edge of the insert 128 and the shoulder portion 126 of the second section 124. The edge (unnumbered) of the insert 128 includes a rubber ring 131 bonded thereto. The outside edge of the insert 128 and the ring 131 define a seat for the valve ball 81 to seal against, as discussed herein in more detail.

The second section 124 of the valve chamber 84 extends through the body 75, and includes the spring cup 88, the retaining plate 89 and the retaining ring 90. The spring cup 88 includes a recess (unnumbered) for an O-ring 134. The spring 83 is received within a cup-shaped portion 135 of the spring cup 88 and biases the valve ball 81 against the valve seat to fluidly seal the second section 124 of the valve chamber 84 from the necked section 122.

The first passage 85 is connected between the gas source 25 and the second section 124 of the valve chamber 84 at a point directly behind the seated valve ball 81. The compressed gas flowing into the second section 124 of the valve chamber 84 provides additional biasing of valve ball 81 into engagement with the valve seat.

A conventional flow control assembly can be included within the first passage 85, such as for example as shown generally at 136. The flow control assembly 136 includes an adjustment screw 138 and a regulator valve 140. The screw 138 is received within a threaded bore 142 and bears against the valve 140. The screw 138 is retained within the bore by retaining plate 89. The bore 142 includes a conical portion 144 which connects the first passage 85 With a short passage 145 to gas source 25.

The regulator valve 140 includes a tip 146 which includes elastomeric material bonded thereto and is adapted to be forced into the conical portion 144 of the bore 142 when the screw 138 is drawn down, as illustrated in FIG. 2. Consequently, when the valve 140 is closed, compressed gas is prevented from flowing from source 25 to the first passage 85. To allow gas to flow, the adjustment screw 138 is drawn up, as shown in FIG. 3, which draws the tip 146 away from the conical portion 144 and permits compressed gas to flow around the tip 146 and into the first passage 85.

The short passage 145 from the bore 142 is connected to a cartridge adapter 148. The adapter 148 is adapted to puncture and seal against the nozzle 150 of a conventional gas source 25, such as a $CO_2$ cartridge. As shown in FIG. 1, the $CO_2$ cartridge is contained in a cavity 152 formed in a handle portion 154 of the housing 20. The handle portion 154 includes a cover 156 which is hinged at 158, and which may be opened to provide access to the cartridge.

The cartridge 25 is secured between the adapter 148 and a holder assembly, indicated generally at 160. The holder assembly 160 includes a cup 162 which engages the bottom portion of the cartridge 25, and a hold down screw 164. The hold down screw 164 is tightened down through a jam nut 166 attached to handle portion 154, so that the cup 162 engages the bottom of the cartridge 25 and forces the cartridge to seal against the adapter 148. A hollow needle (not shown) in the adapter 148 pierces the seal on the cartridge nozzle 150 and allows compressed gas to flow from the cartridge into the valve assembly 76.

To remove the cartridge 25, the hinged cover 156 is opened and the hold down screw 164 is untightened, which releases the pressure of the cup 162 against the cartridge bottom, and allows removal of an exhausted cartridge. A fresh cartridge is inserted within the cavity 152 and the cup 162 is again tightened against the cartridge to force the cartridge nozzle 158 into the adapter.

The $CO_2$ cartridge is conventional in design and is manufactured by a variety of companies, including Crossman Air Guns. The cartridge is disposable and is adapted to be removed and replaced when exhausted. Cartridges having other suitable propellants besides $CO_2$ can also be used with the present invention.

The operation of the dispensing device 5 is as follows. When the trigger 110 is depressed, the trigger piston 80 is urged against the valve ball 81 and the exhaust passage 98 is sealed against the ball 81, as shown in FIG. 3. The valve ball 81 is moved away from the valve seat, and compressed gas flows at saturated pressure from the $CO_2$ cartridge through an open valve 136 and the first passage 85 to the second section 124 of valve chamber 84. The gas flows around the valve ball 81 and the necked portion 92 of the trigger piston 80 to the second passage 87. The gas flows through the second passage 87 and into the rear portion of the actuating chamber 79.

The actuating chamber 79 comprises a longitudinally extending bore formed in body 75, and is adapted to slidingly receive the actuating piston 78 therein. The actuating piston 78 includes a tapered rear end 168, and a forward end 170 having a driving surface 171. A conventional O-ring 172 is received within a circumferential groove (not numbered) formed in the actuating piston 78 to prevent compressed gas from escaping around the piston.

The compressed gas flowing through the second passage 87 enters the rear of the actuating chamber 79 and surrounds the tapered portion 168 of the actuating piston 78. The pressure within the rear of the chamber 79 increases, which forces the piston 78 outwardly from the chamber 79. The forward, driving surface 171 of the piston 78 engages an off-center portion of the drive washer 55. The drive washer 55 thereby cocks and grabs the push rod 42.

As the actuating piston 78 moves outwardly from the actuating chamber 79, the push rod 42 is thereby moved forwardly within the tube holder 10 (FIG. 1) during the stroke of the piston 78. The drive piston 61 (FIG. 1) connected to the push rod 42 is thereby forced against a caulking tube piston to dispense the caulking product. The actuating piston 78 continues to advance from the actuating chamber 79 into an extended position until the spring 65 is compressed and prevents further forward movement.

Accordingly, the movement of the push rod 42, and hence the drive piston 61, in the dispensing device is limited to the stroke of the actuating piston 78. The movement of the push rod 42 is therefore only a small increment of its total possible movement.

When the drive washer 55 reaches the end of the stroke, the pressure within the actuating chamber 79, the first passage 85, the second passage 87, and the valve assembly 84 is essentially in equilibrium. When the trigger 110 is released, as shown in FIG. 2, the spring 83 in the valve assembly 84, and the pressure of gas from the gas source 25 bias the valve ball 81 and trigger piston 80 back into their original positions. The valve ball 81 is thereby urged into engagement with the valve seat to seal the second section 124 of the valve chamber 84 from the first section 99 and prevent further compressed gas from entering the actuating chamber 79.

After the trigger 110 is released, the gas pressure in the necked section 122 moves the trigger piston 80 out of engagement with the valve ball 81, which thereby opens the exhaust passage 98. The trigger piston 80 urges the trigger 110 towards its initial position until edge 172 of trigger 110 engages side 174 of aperture 113.

The gas contained in the actuating chamber 79, as well as the small amount of gas in the second passage 87, flows out through the exhaust passage 98, thereby reducing the pressure in the actuating chamber 79. The reduced pressure in the actuating chamber 79 allows the actuating piston 78 and the drive washer 55 to be biased by spring 65 back into their initial positions for the next trigger actuation.

The drive assembly 15, pressure regulating assembly 22, and gas source 25 thereby provide incremental movement of the drive piston 61 (FIG. 1) against the tube piston to dispense the caulking compound or other viscous or plastic material. The amount of compressed gas needed for this process is determined by the short stroke of the actuating piston 78 and the small volume of the passages. Moreover, the amount of exhausted or leaked $CO_2$ is minimized.

A subsequent actuation of the trigger 110 will cause another incremental movement of the push rod 42. Release of the trigger 110 will again allow biasing of the actuating piston 78 and drive washer back 55 into their original positions. Hence, each incremental movement of the push rod 42 will be accomplished by a single stroke of the actuating piston 78. Each full stroke requires the same amount of compressed gas, irrespective of the location of the drive washer 55 along the push rod 42.

Figure 4:
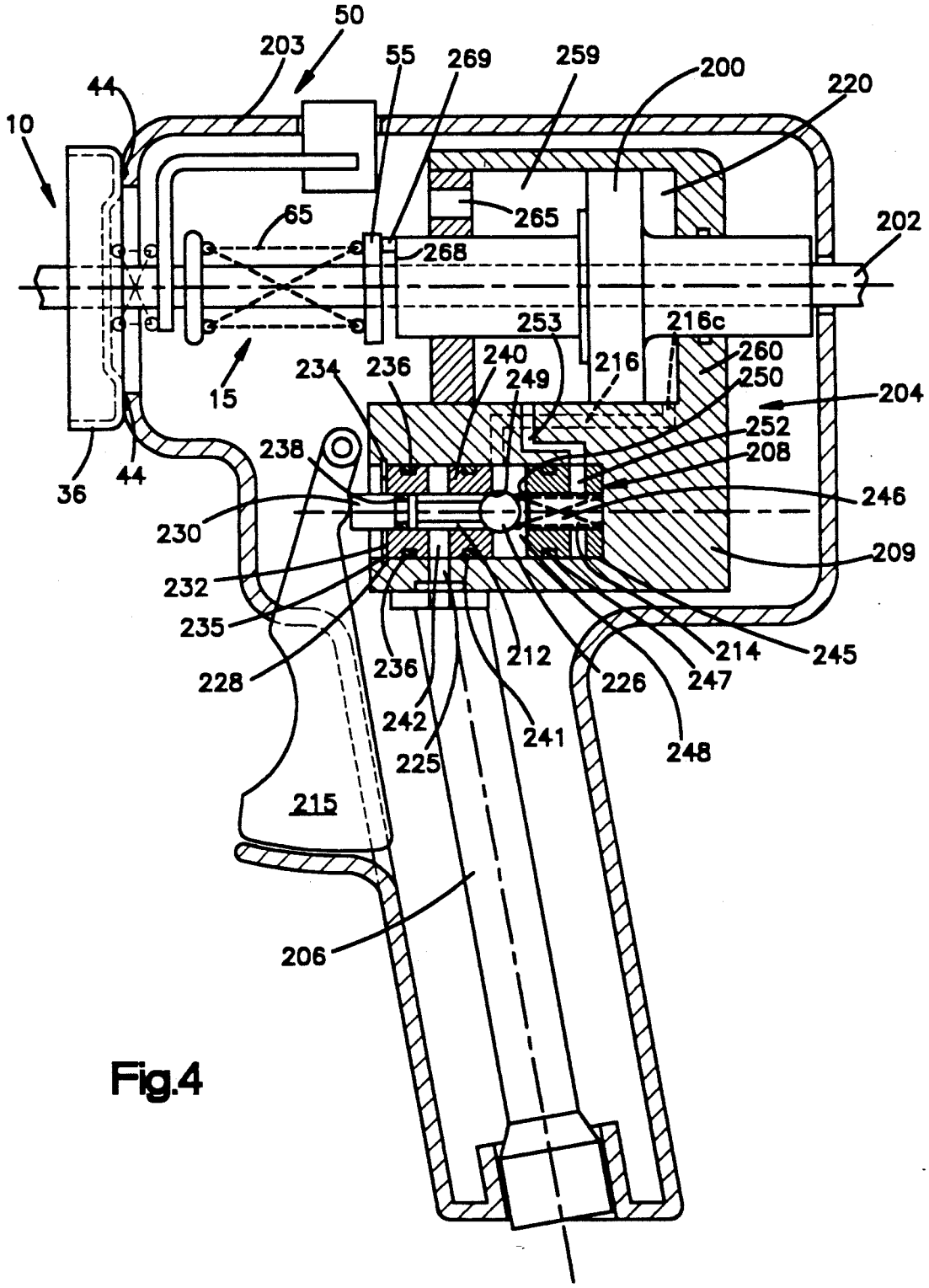
FIG. 4 is a detailed partial sectional view similar to FIG. 2 of a second embodiment of the dispensing device, showing the pressure regulating assembly in an initial position.

In a second embodiment of the invention, as shown in FIG. 4, the dispensing device includes an actuating piston 200 mounted coaxially with a push rod 202. In this embodiment, an air hose (not shown) can be used to supply compressed air to the dispensing device from a conventional air compressor. Alternatively, a rolling diaphram (not shown) can be used in place of the sliding actuating piston 200.

In the second embodiment, the tube holder 10, the drive assembly 15, and the locking assembly 50 are substantially the same as in the first embodiment, and hence the same reference numbers will apply. Further, the tube holder 10 includes a second end piece 36 which is attached by spot welds 44 to a housing 203. The housing 203 at least partially encloses the drive assembly 15, a pressure regulating assembly, indicated generally at 204, and tubing 206.

Figure 7:
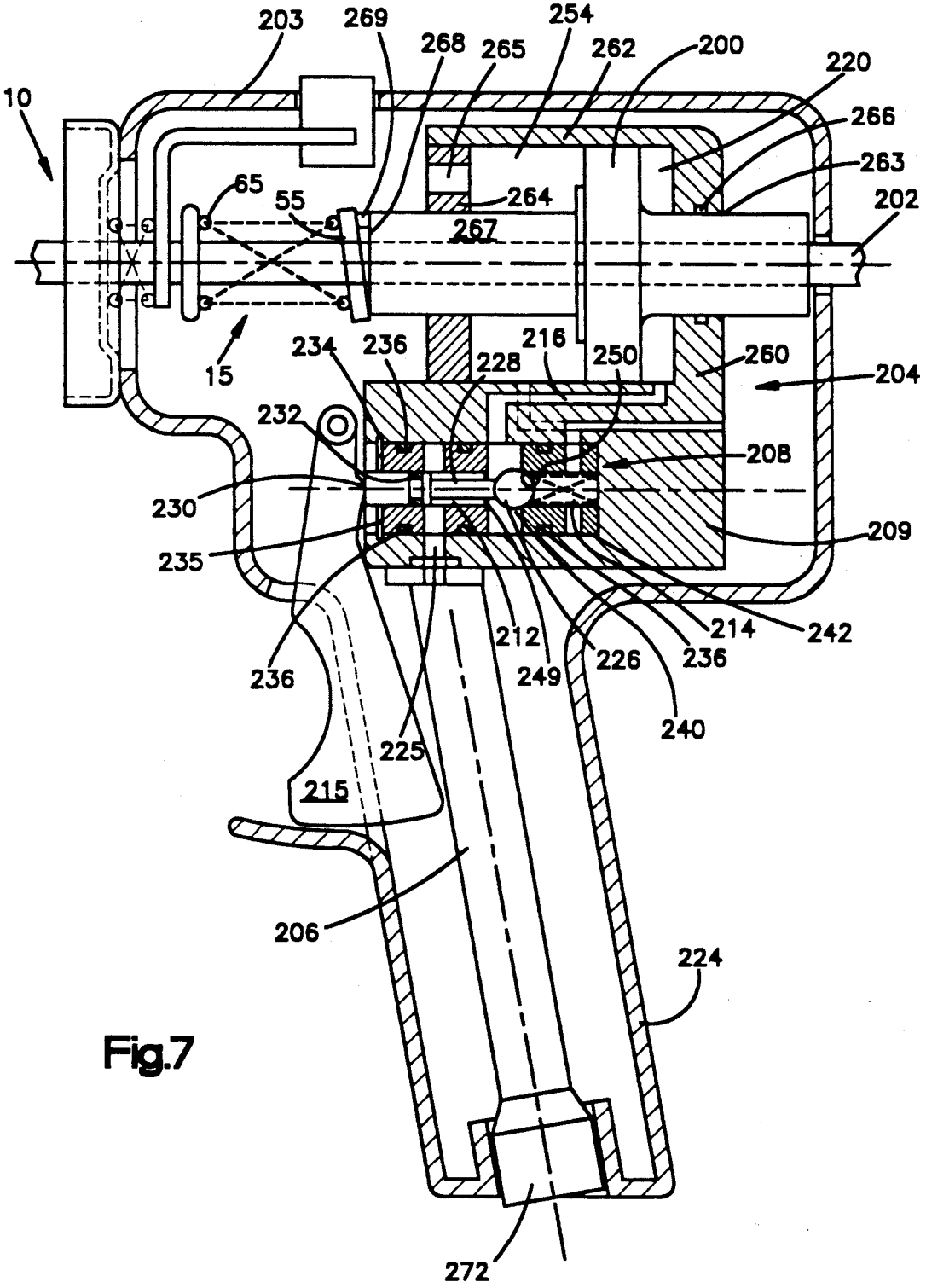
FIG. 7 is a detailed partial sectional view similar to FIG. 2 of the second embodiment of the dispensing device, showing the pressure regulating assembly in an extended position.

The pressure regulating assembly 204 includes a valve chamber, indicated generally at 208, formed in a body 209. The valve body 209 is formed from aluminum or other appropriate material. The chamber 208 is adapted to receive a valve 212 and a spring 214. As shown in FIG. 7, trigger 215 is adapted to urge the valve 212 away from a valve seat 249 and into sealing engagement with seat 250. This allows compressed air to flow from tubing 206 through a first air passage 216, and into the rear of an actuating chamber 220. The increase in pressure in the actuating chamber 220 forces the actuating piston 200 forwardly against the drive washer 55 to dispense the caulking compound or other viscous or plastic material.

To this end, the air hose from a conventional air compressor is removably connected to the tubing 206 through a conventional connector assembly 222 in a handle portion 224 of the housing 203. The tubing 206 extends to a short passage 225, which is connected to the pressure regulating assembly 204 and supplies the assembly with compressed air.

Referring again to FIG. 4, the valve 212 is formed from a one-piece aluminum design and includes a valve ball 226, a connecting rod 228 and a piston head 230. The piston head 230 includes a circumferentially formed groove (not numbered) which is designed to receive an O-ring 232 therein. The valve 212 extends through an aperture (not numbered) formed in a first molded plastic insert 234. The O-ring 232 engages the inside of the first molded insert 234 in the valve chamber 208 to prevent air from escaping through the valve chamber. The molded insert 234 is retained within valve chamber 208 by a retaining ring 235. Additional O-rings 236 are also provided between the molded insert 234 and the valve chamber 208.

The valve 212 further extends through an aperture (not numbered) formed in a second molded plastic insert 240 in the valve chamber 208. An O-ring 241 is provided in a recess (unnumbered) in the second molded insert 240. The first molded insert 234 includes a spacer (not shown) which separates insert 134 from the second molded insert 240 and forms a bore 242 therebetween. Bore 242 is connected by passage 225 to tubing 206.

The second molded insert 240 is received towards the inner end 245 of the valve chamber 208. The second insert 240 includes an axially extending bore 246 formed therein. The bore 246 at least partially receives the spring 214. The second insert 240 includes a recess (not numbered) designed to receive an O-ring 247 therein.

The second insert 240 further includes a laterally extending exhaust bore 248. The end 249 of the aperture in the second insert 240 forms a first valve seat for the valve head 226, while the open end 250 of bore 246 forms a second valve seat for the valve head 226. The bore 248 is connected by the first passage 216 (FIG. 7) to the rear of the actuating chamber 220.

The second insert 240 further includes a laterally extending bore 252. The bore 252 extends at least partially into the axial bore 246. The bore 252 is connected by a second passage 253 to the forward portion 254 of the actuating chamber 220.

The valve 212 is located in the valve chamber 208 such that the valve ball 226 can axially reciprocate within the lateral bore 248. The valve head 230 and the connecting rod 228 are slidingly received within the first insert 234. The valve ball 226 is adapted to reciprocate between the first valve seat 249 and the second valve seat 250 and seal to a respective seat. The spring 214 extends partially out of bore 246 and normally biases the valve ball 226 forwardly into engagement with the first valve seat 249.

When compressed air is initially applied to the valve chamber 208 through the tubing 206, the air flows through the bore 242 and around the connecting rod 228. Specifically, the compressed air is applied simultaneously against both the piston head 230 and the valve ball 226. Accordingly, the valve ball 226 is not initially urged out of its spring biased, sealing engagement with the first valve seat 249.

As shown in FIG. 7, the trigger 215 is adapted to engage the piston head 230 of valve 212, and urge the valve ball 226 away from its initial engagement with the first valve seat 249 and into sealing engagement with the second valve seat 250. The compressed air can thereby pass around the connecting rod 228 and valve ball 226, up through passage 216, and into the rear of the actuating chamber 220.

Figure 5:
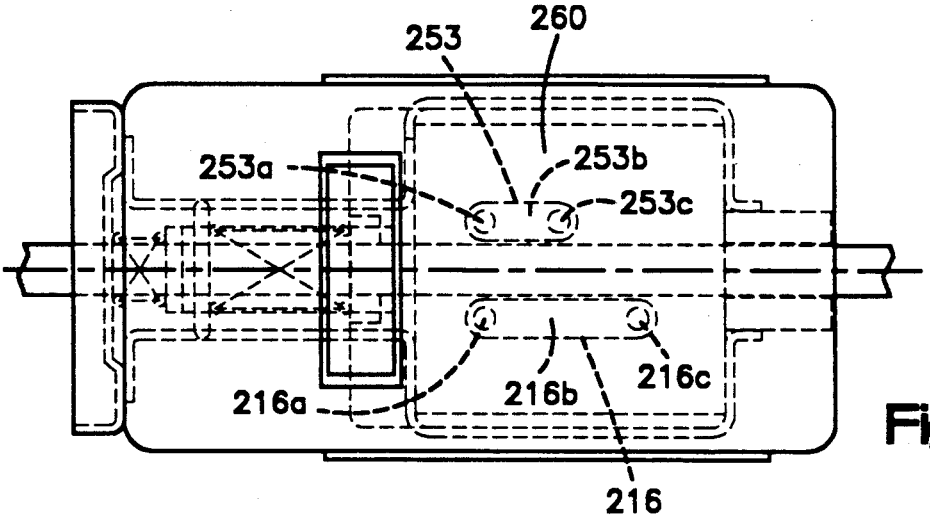
FIG. 5 is a partial plan view of the dispensing device of FIG. 4.
Figure 6:
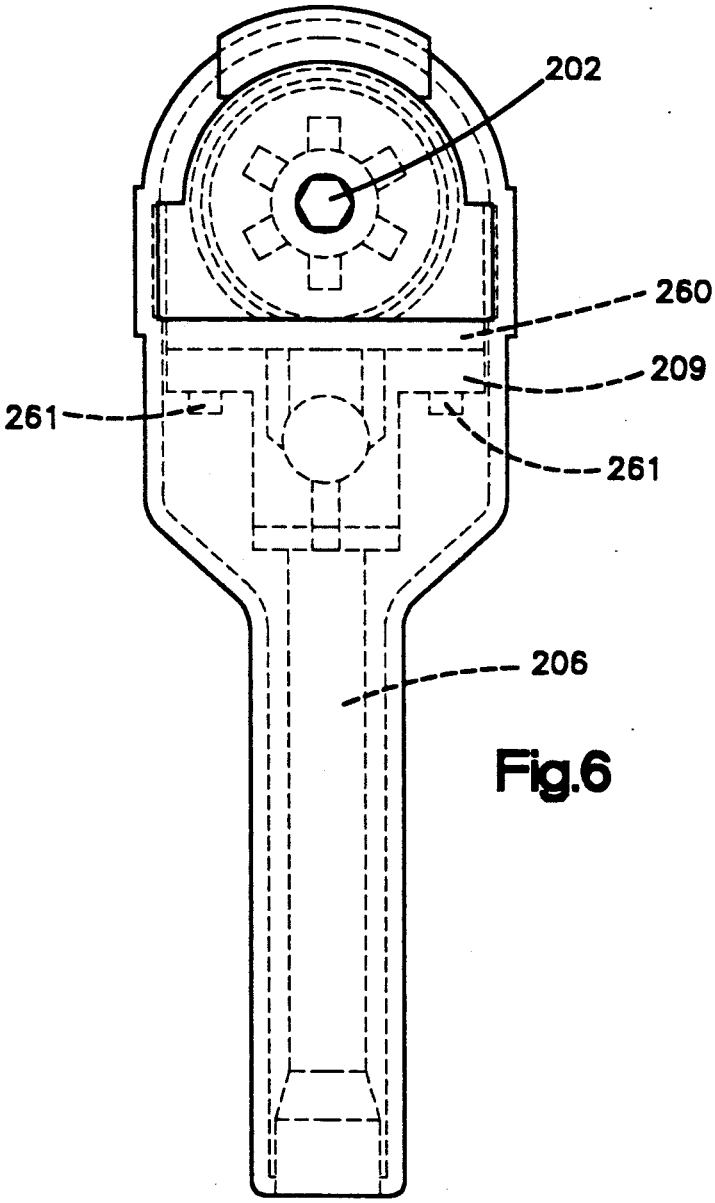
FIG. 6 is an end elevational view of the dispensing device of FIG. 4.

The first air passage 216 extends from the valve chamber 208 to the actuating chamber 220 and, along with the second air passage 253 (FIG. 4), is formed in two parts. In particular, as shown in FIGS. 5 and 6, the first vertically extending portion 216*a* of the first air passage 216 (FIG. 7) and the horizontally extending portion 216*b* are formed in the body 209. The second vertically extending portion 216*c*, however, is formed in a cylinder body 260. The cylinder body 260 is adapted to be attached and sealed to the body 209 with bolts 261 (FIG. 6) and sealing rings (not shown) to provide the whole passage 216. Similarly, the second air passage 253 has a first vertical portion 253*a*, and a horizontally extending portion 253*b* formed in the body 209. A second vertical portion 253*c* is formed in the body 260.

Referring again to FIG. 7, the cross sectional area of cylinder body 260 forms a C-shaped shell 262. The shell 262 includes an aperture 263 adapted to allow relative movement of the push rod 202 and the actuating piston 200. The chamber 220 further includes a forward plate 264 secured between the open ends of the C-shaped shell 262. The forward plate 264 includes an exhaust opening 265 formed therein. An O-ring 266 is located within a recess (unnumbered) in the actuating piston to prevent the compressed air from leaking between the aperture 263 in the shell 262 and the actuating piston 200.

As the compressed air enters the rear of chamber 220, the pressure increases within the chamber. The increased pressure urges the piston 200 forwardly within the actuating chamber 220. Air located in the forward portion 254 of the actuating chamber 220 is pushed out through the exhaust opening 265 as the piston 200 moves forwardly within the chamber 220.

The piston 200 includes a drive sleeve 267 extending co-axially along the push rod 202. The drive member 267 includes a forward end 268. The forward end 268 is adapted to engage an abutment 269 on the drive washer 55 and drive the washer 55 off-center to cock and grab the push rod 202. The actuating piston 200 is thereby adapted to move the push rod 202, and hence the drive piston 61 (FIG. 1) forwardly within the tube holder 10 for the stoke of the actuating piston 200.

When the trigger 215 is released, as shown in FIG. 4, the spring 214 biases the valve ball 226 back into its seated engagement with the first valve seat 249. The valve ball 226 thereby opens the exhaust passage 253 within the valve chamber 208 and allows the compressed air in the actuating chamber 220 and in the first passage 216 to flow through the axial bore 246 and through the second passage 253 to the forward portion 254 of the actuating chamber.

The air flowing into the forward portion 254 of the actuating chamber temporarily increases the pressure in the forward portion 254 and simultaneously decreases the pressure in the rear of the chamber 220. This equalization of pressure permits the spring 65 to uncock washer 55 and urge the washer 55 and actuating piston 200 back into their original positions. Any excess air flowing into the forward portion 254 is eventually discharged through exhaust opening 265.

Figure 8:
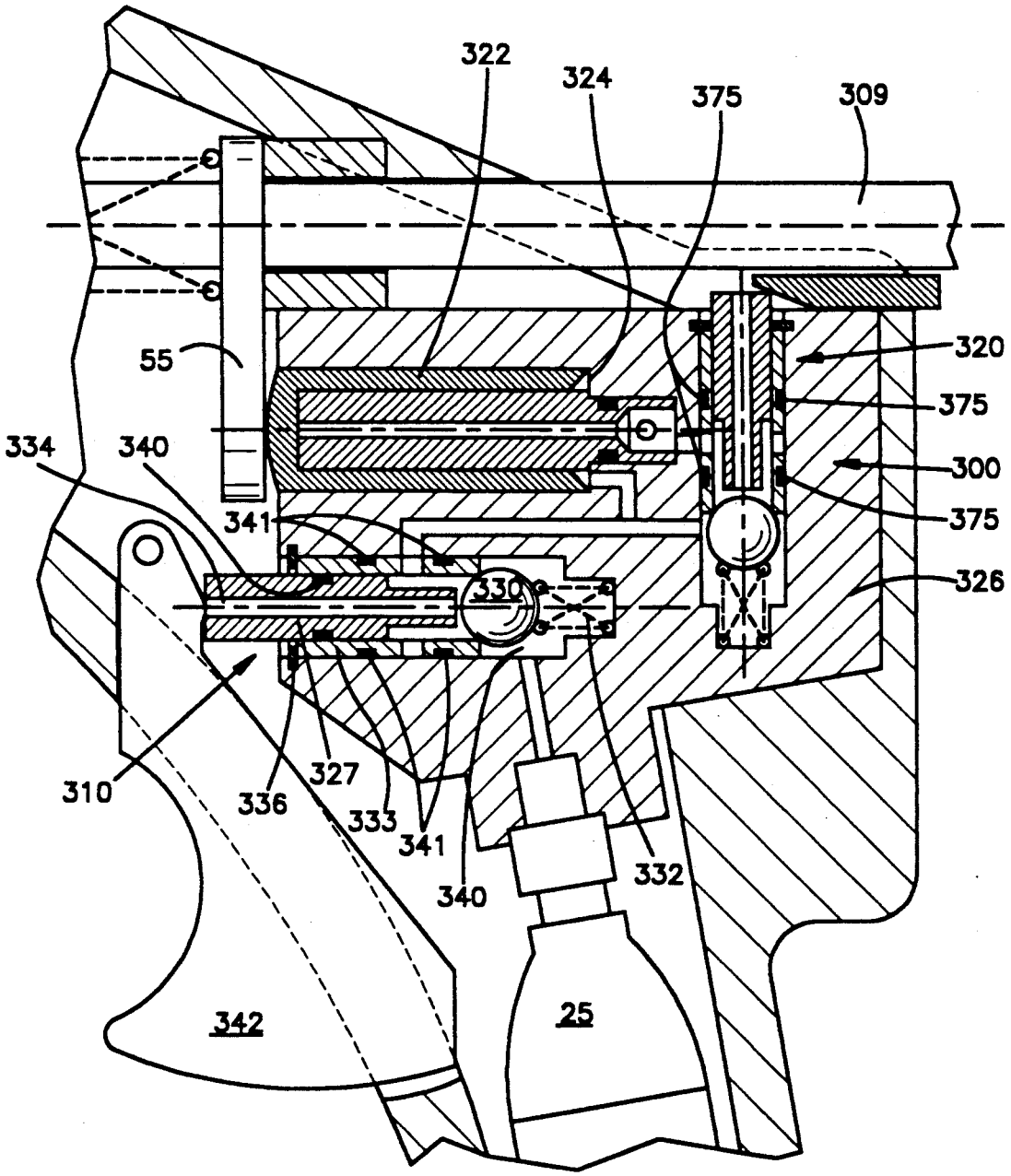
FIG. 8 is a detailed partial sectional view similar to FIG. 2 of a third embodiment of the dispensing device, showing the first and second valve assemblies in their initial positions.
Figure 9:
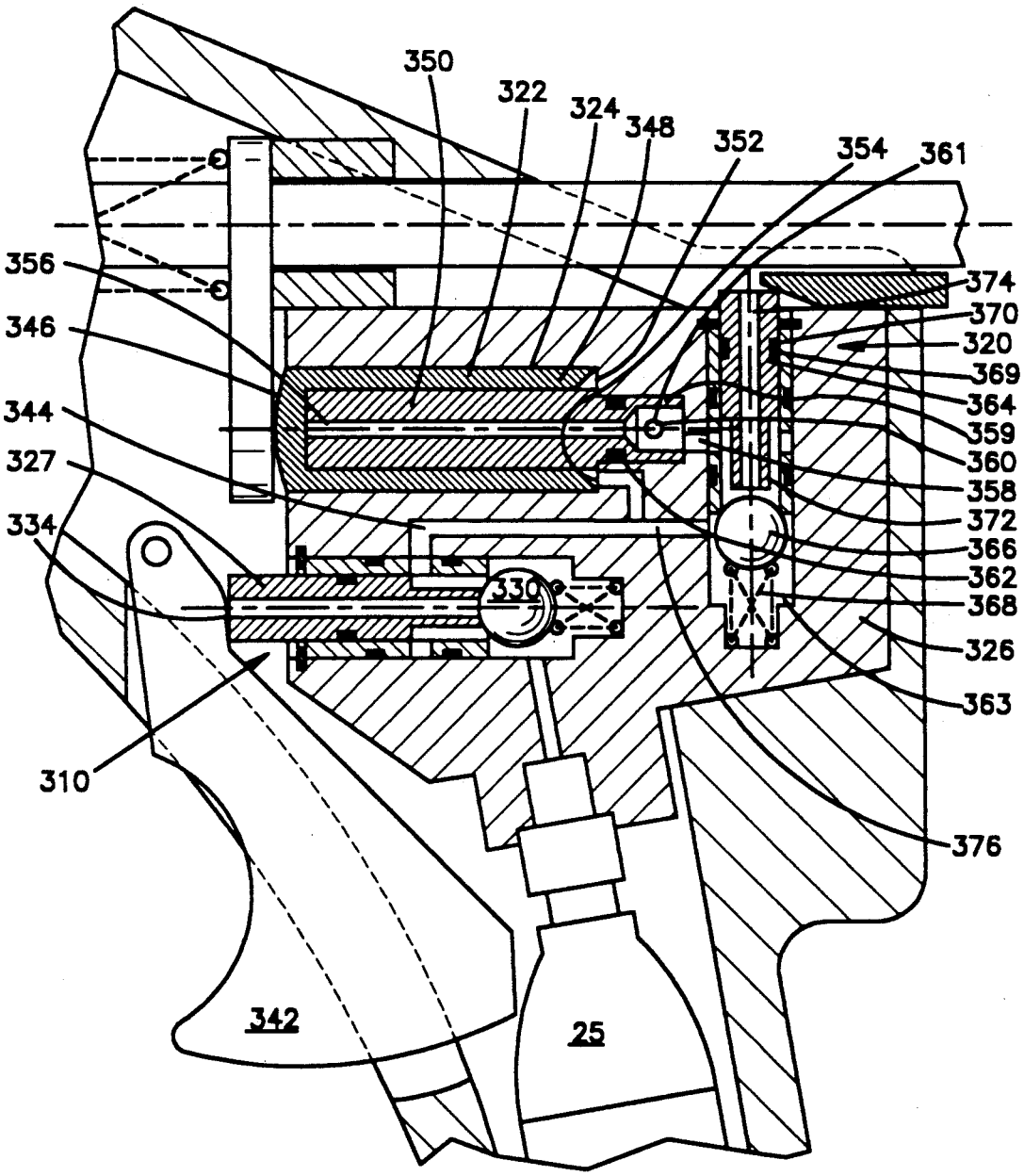
FIG. 9 is a detailed partial sectional view of the pressure regulating assembly of FIG. 8, showing the first valve of the pressure regulating assembly in its extended position and the second valve in its initial position.
Figure 10:
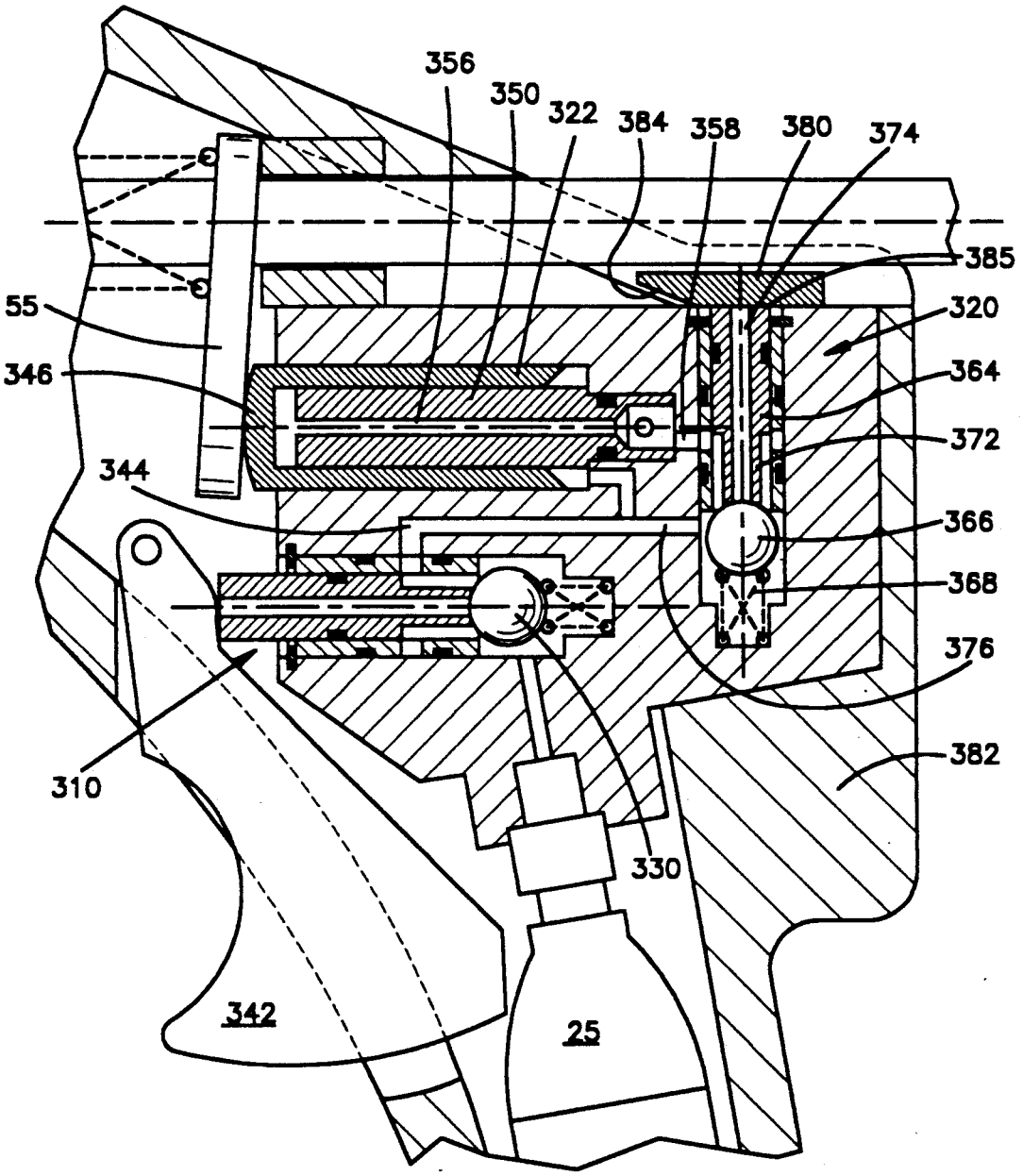
FIG. 10 is a detailed partial sectional view of the pressure regulating assembly of FIG. 8, showing the first and second valves of the pressure regulating assembly in their extended positions.

In a third embodiment of the invention, as shown in FIGS. 8–10, a dual piston and dual valve dispensing device is disclosed. Such a dispensing device can be used, for example, in situations where the viscosity of the caulking compound or other material varies.

In the third embodiment, the compressed gas source 25 provides compressed gas to drive the washer 55 off-center against a push rod 309. A modified pressure regulating apparatus, indicated generally at 300, provides a varying level of drive force against the washer 55, depending on the viscosity of the caulking compound or other material.

To this end, a first valve assembly, indicated generally at 310, and a second valve assembly, indicated generally at 320, are adapted to allow the compressed gas to be applied to an actuating piston 322 within an actuating chamber 324.

The first and second valve assemblies 310, 320 are each similar to the valve assembly 77 (FIG. 1) described in the first embodiment. In particular, the first valve assembly 310 includes a valve chamber 325 formed in a body 326. The valve chamber 325 includes a trigger piston 327, a steel valve ball 330 and a spring 332 which biases the ball 330 against a valve seat formed by sleeve 333. The trigger piston 327 is adapted to be urged against the ball to seal an exhaust passage 334 extending through piston 327. Also included is a retaining ring 336 which secures the sleeve 333 within the valve chamber 325, an O-ring 340 located in a recess (unnumbered) formed in the trigger piston 327, and various other sealing O-rings 341.

Manually depressing a trigger 342 moves the trigger piston 327 against the valve ball 330 in the first valve assembly 310, as shown in FIG. 9, and allows compressed gas from a gas source 25 to flow into a first passage 344. Releasing the trigger 342 allows gas to exhaust through the exhaust passage 334 formed in piston 327.

The actuating piston 322 in the third embodiment comprises a cup-shaped member having a drive surface 346 and a sleeve portion 348 extending outwardly therefrom. The actuating piston 322 is received around a piston shaft 350 and is adapted to slide within the actuating chamber 324. The first passage 344 is connected between the first valve assembly 310 and the rear 352 of the actuating chamber 324. The end of the sleeve portion 348 is tapered at 354, and the first passage 344 allows compressed gas to flow between the tapered end 354 of the actuating piston 322 and the rear 352 of the actuating chamber 324.

The shaft 350 includes a longitudinally extending bore 356 formed therethrough which is connected to the second valve assembly 320 through a second passage 358. The shaft 350 includes an annular necked portion 359 having an aperture 360 formed therein and connected between the bore 356 and the passage 358. A pin 361 is inserted within the aperture 360 and secures the shaft 350 to the body 326. An O-ring 362 is included in a recess (unnumbered) in the necked portion 359 to prevent compressed gas from flowing around the shaft 350.

The second valve assembly 320 is similar in design to the first valve assembly 310. In particular, the second valve assembly 320 includes a valve chamber 363 formed in body 326. The valve chamber 363 includes a trigger piston 364, a valve ball 366, and a spring 368 that biases the valve ball 366 against a valve seat formed by a sleeve 369. The trigger piston 364 projects outwardly from the valve chamber 363 and includes O-ring 370. The drive piston 364 includes a forward necked portion 372 and a exhaust passage 374 extending through the piston 364. The valve chamber 363 further includes O-rings 375. The forward necked portion 372 is adapted to contact the valve ball 366 and move the valve ball 366 away from the valve seat (FIG. 10).

The first passage 344 includes an extension 376 that connects the passage 344 with the second valve assembly 320 and taps off a portion of the compressed gas flowing therein. The extension passage 376 is connected to the second valve assembly 320 at a point rearwardly from the seated valve ball 366. As with the first valve assembly 310, the compressed gas received through the extension 376 of the second passage 344 cooperates with the spring 368 to initially bias the valve ball 366 into a sealing relationship with the valve seat.

When the valve ball 366 is dislodged from its seat by the trigger piston 364, as shown in FIG. 10, compressed gas flows through the extension 376 in the first passage 344, around the valve ball 366, around the necked portion 372, and into the short second passage 358. The compressed gas enters the second passage 358 and flows through bore 356 to bear against the actuating piston 322.

The trigger piston 364 in the second valve assembly 320 is urged into engagement with the valve ball 366 by a slide or ramp switch 380 located on the housing 382. The switch 380 is slidingly attached to the housing 382 and has a ramped portion 384 which is adapted to engage the end 385 of the trigger piston 364 and drive the piston 364 into sealing engagement with the valve ball 366. The compressed gas enters the bore 356 within the shaft 350 and increases the pressure against the actuating piston 322, thereby forcing the piston outwardly from the actuating chamber 324 and against the drive washer 55.

For a low viscosity caulking compound, the first valve assembly 310 can be used independently of the second valve assembly 320 to provide adequate dispensing characteristics for the dispensing device. In this case, the second valve assembly 320 can remain inoperative by moving the switch 380 away from engagement with the drive piston, as shown in FIGS. 8 and 9. In this manner, the bore 356 of shaft 350 is fluidly connected to the exhaust passage 374 in the trigger piston 364 to maintain an ambient pressure in the bore 356 during the movement of the actuating piston 322. Using the single valve assembly 310 reduces the amount of compressed gas necessary to dispense the low viscosity product from the dispensing device.

However, when a higher viscosity material is being dispensed, the first and second valve assemblies 310, 20 can be used simultaneously. In this case, the switch 380 can be driven against the trigger piston 364 to force the valve ball 366 from the valve seat and allow compressed gas to flow into the bore 356 within shaft 350, as shown in FIG. 10. The second valve assembly 320 provides additional compressed gas to the actuating piston 322. The extra piston area that the gas is being applied to will provide for increased force against the drive washer 55 and proper dispensing of the highly viscous product.

Accordingly, the foregoing embodiments describe a dispensing device which provides for dispensing caulking compounds or other viscous or plastic material in a manner which anticipates the economic considerations consonant with using liquified gas. Additionally, the present invention increases the effectiveness of a dispensing device by eliminating sputtering at the nozzle and tilting of the tube piston caused by compressed gas or air being applied directly to the tube piston. Moreover, the device provides for incremental movement of the drive piston against the tube piston for dispensing of the material.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the spirit of the present invention.

For example, a larger tube, such as a 30 oz. caulking tube, can be used with the dispensing device. The relative size of the pistons, valves and drive washer can be increased in such a case to compensate for the additional force required to drive the tube piston within the caulking tube. Accordingly, the foregoing detailed description should be exemplary in nature and not as limiting to the scope and spirit of the invention set forth in the appended claims.

What is claimed is:

1. A fluid operated dispensing device, compressing:

receiving means adapted to receive and dispense a viscous product;

a drive means disposed at least partially within the receiving means and adapted to urge the viscous product from the receiving means;

an actuating chamber;

an actuating piston adapted to reciprocate between an initial position and an extended position within said actuating chamber, said actuating piston being engageable with means surrounding said drive means for contacting and incrementally moving said drive means in a forward direction;

biasing means normally biasing said actuating piston to its initial position;

means for selectively supplying fluid to a portion of the actuating chamber to increase the pressure within the chamber and drive the actuating piston against its bias from its initial position to its extended position, and means to selectively exhaust said fluid from said portion of the actuating chamber to allow said actuating piston to return from its extended position to its initial position, whereby each activation of said actuating piston incrementally moves said drive means forward, and locking means normally engaging said drive means to prevent movement of said drive means in the reverse direction, said locking means being disengageable from said drive means to allow manual movement of said drive means in said reverse direction.

2. A dispensing device as in claim 1, wherein said drive means comprises a drive piston and a push rod, said actuating piston being engageable with means in contact with said push rod to incrementally move said drive piston and said push rod within said receiving means.

3. A dispensing device as in claim 2, wherein said means in contact with said push rod includes a washer located around said push rod and biased in an initial position and adapted to be driven off-center and against said push rod into an extended position with said actuating piston.

4. A dispensing device as in claim 1, wherein said dispensing device comprises a caulking gun adapted to dispense a caulking product.

5. A fluid operated dispensing device as in claim 1, further including locking means separate from said means in contact with said device means to prevent movement of said drive means in the reverse direction, and means to disengage said locking means to allow movement of said drive means in said reverse direction.

6. A dispensing device as in claim 1, wherein the fluid comprises air.

7. A dispensing device as in claim 1, wherein said means for selectively supplying fluid comprises at least one valve assembly and a fluid source, at least one of said valve assemblies having valve means adapted to selectively supply fluid from said fluid source to the portion of said actuating chamber.

8. A dispensing device as in claim 7, wherein at least one of said valve assemblies includes a trigger piston and a valve ball located within a valve chamber and biased by a spring.

9. A dispensing device as in claim 7 further including flow control means to limit the fluid flow into the valve assembly.

10. A dispensing device as in claim 8, wherein said trigger piston includes an exhaust passage extending axially therethrough, said exhaust passage adapted to selectively exhaust said fluid from said actuating piston.

11. A dispensing device as in claim 7, wherein said means for selectively supplying fluid includes a replaceable $CO_2$ cartridge, said $CO_2$ cartridge adapted to provide fluid to said portion of said actuating chamber.

12. A dispensing device as in claim 7, wherein said dispensing device includes a compressed air source, said compressed air source adapted to provide compressed air to said portion of said actuating chamber.

13. A fluid operated dispensing device as in claim 1, further including means for selectively supplying fluid to two separate portions of the actuating chamber to increase the pressure within the actuating chamber and drive the actuating piston against its bias from its initial position to its extended position.

14. A fluid operated dispensing device as in claim 1, wherein said locking means includes a locking lever which is normally spring biased to prevent movement of said drive means in said reverse direction but allow movement of said drive means in said forward direction.

15. A method for dispensing a viscous product from a dispensing device, comprising:

providing a receiving and dispensing means in the dispensing device with viscous product, biasing an actuating piston and a washer into an initial position;

applying fluid to a portion of an actuating chamber to increase the pressure within the chamber and force the actuating piston against its bias from the initial position to an extended position;

engaging and incrementally moving the washer off-center with the actuating piston said off-center washer grabbing and moving a push rod in a forward direction;

moving a drive piston connected to the push rod in the forward direction within said receiving and dispensing means to bear against the viscous product, dispensing the viscous product from the dispensing device, and manually grasping and moving said push rod in a reverse direction such that said drive piston also moves in the reverse direction in said receiving and dispensing means.

16. A method for dispensing a viscous product from a dispensing device as set forth in claim 15, wherein said step of engaging and incrementally moving the washer off center comprises engaging and incrementally moving the washer off center with an actuating piston at least partially surrounding and slidable relative to the push rod.

17. A fluid operated dispensing device, comprising:

receiving means adapted to receive and dispense a viscous product;

drive means disposed at least partially within the receiving means and adapted to urge the viscous product from the receiving means;

an actuating chamber;

an actuating piston adapted to reciprocate between an initial position and an extended position within said actuating chamber, said actuating piston having means in contact with said drive means to incrementally move said drive means;

biasing means normally urging said actuating piston to its initial position;

means for selectively supplying fluid to a portion of the actuating chamber to increase the pressure within the chamber and drive the actuating piston from its initial position to its extended position, said means for selectively supplying fluid comprising a first and second valve assembly, said first and second valve assemblies including valve means to selectively supply fluid from said fluid source to the actuating chamber, and means to selectively exhaust said fluid from said portion of the actuating chamber to allow said actuating piston to return from its extended position to its initial position whereby each activation of said actuating piston incrementally moves said drive means.

18. A method for dispensing a viscous product from a dispensing device, comprising:

providing a receiving and dispensing means in the dispensing device with viscous product, biasing in actuating piston and a washer into an initial position;

selectively applying fluid through at least one of a pair of valve assemblies to a portion of an actuating chamber to increase the pressure within the chamber and force the actuating piston against its bias from the initial position to an extended position, each of said pair of valve assemblies being capable of applying fluid to a separate portion of the actuating chamber;

engaging and incrementally moving the washer off-center with the actuating piston said off-center washer grabbing and moving a push rod;

moving a drive piston connected to the push rod within said receiving and dispensing means to bear against the viscous product, and dispensing the viscous product from the dispensing device.

19. A fluid operated dispensing device, comprising:

a receiving means adapted to receive and dispense a viscous product, a drive means disposed at least partially within the receiving means and adapted to urge the viscous product from the receiving means, an actuating chamber, a first piston adapted to reciprocate between an initial and an extended position within the actuating chamber, said first piston having means in contact with said drive means to incrementally move the drive means within the receiving means, means for applying fluid to a portion of the actuating chamber to move the first piston within the actuating chamber, said means for applying fluid including a first valve assembly having a second piston and a valve ball disposed within a valve chamber, and a second valve assembly having a third piston and a second valve ball disposed within a second valve chamber, said second piston including an exhaust passage formed therein adapted to allow fluid to exhaust from the dispensing device to allow said first piston to return from its extended position to its initial position.

20. A fluid operated dispensing device, comprising:

receiving means adapted to receive and dispense a viscous product;

a drive means comprising a drive piston and a push rod disposed at least partially within the receiving means and adapted to urge the viscous product from the receiving means;

an actuating chamber;

an actuating piston adapted to reciprocate between an initial position and an extended position within said actuating chamber, said actuating piston having means in contact with said push rod to incrementally move said drive piston and said push rod within said receiving means, said means in contact with said push rod including a washer located around said push rod and adapted to be drive off center and against said push rod by said activating piston;

biasing means normally biasing said actuating piston to its initial position, said biasing means including a spring located around said push rod in contact with said washer and adapted to bias said washer and said actuating piston into said initial positions;

means for selectively supplying fluid to a portion of the actuating chamber to increase the pressure within the chamber and drive the actuating piston against its bias from its initial position to its extended position, and means to selectively exhaust said fluid from said portion of the actuating chamber to allow said actuating piston to return from its extended position to its initial position, whereby each activation of said actuating piston incrementally moves said drive means.

21. A fluid operated dispensing device as in claim 20, wherein said washer is normally maintained in an off-center orientation with respect to said push rod.

22. A fluid operated dispensing device, comprising:

a receiving means adapted to receive and dispense a viscous product, a drive means disposed at least partially within the receiving means and adapted to urge the viscous product from the receiving means, an actuating chamber, a first piston adapted to reciprocate between an initial and an extended position within the actuating chamber, said first piston having means in contact with said drive means to incrementally move the drive means in a forward direction within the receiving means, means for applying fluid to a portion of the actuating chamber to move the first piston within the actuating chamber, said means including a valve assembly having a second piston and a valve ball disposed within a valve chamber, said second piston including an exhaust passage formed therein, said exhaust passage adapted to allow fluid to exhaust from the dispensing device to allow said first piston to return from its extended position to its initial position, and means to allow said drive means to be moved in a reverse direction in said receiving means.

23. A fluid operated dispensing device as in claim 23, wherein said means in contact with said drive means includes a washer located around said drive means, said washer adapted to be driven off center by said first piston and against said drive means to move said drive means in said forward direction, and being normally biased in said reverse direction to bias said first piston into said initial position.

24. A fluid operated dispensing device as in claim 25, wherein said exhaust passage in said second piston is normally uncovered to allow fluid to exhaust from said dispensing device and said valve ball is normally biased into a should formed in said valve assembly to prevent fluid from being applied to said actuating chamber, said second piston being designed to engage said valve ball to cover said exhaust passage and to unseat said valve ball from said shoulder to allow fluid to be applied to said actuating chamber and move the first piston within the actuating chamber.

25. A fluid operated dispensing device, comprising:

receiving means adapted to receive and dispense a viscous product;

a drive means disposed at least partially within the receiving means and adapted to urge the viscous product from the receiving means;

an actuating chamber;

an actuating piston adapted to reciprocate between an initial position and an extended position within said actuating chamber, said actuating piston having means in contact with said drive means to incrementally move said drive means;

biasing means normally biasing said actuating piston to its initial position;

means for selectively supplying fluid to two separate portions of the actuating chamber comprising a pair of valve assemblies to increase the pressure within the actuating chamber and drive the actuating piston against its bias from its initial position, one of said pair of valve assemblies adapted to selectively provide fluid to one of said two separate portions of said actuating chamber, and the other of said pair of valve assemblies adapted to selectively provide fluid to the other of said two separate portions of said actuating chamber, and means to selectively exhaust said fluid from said portion of the actuating chamber to allow said actuating piston to return from its extended position to its initial position, whereby each activation of said actuating piston incrementally moves said drive means.

26. A fluid operated dispensing device, comprising:

receiving means adapted to receive and dispense a viscous product;

an actuating chamber;

a drive means disposed at least partially within the receiving means and adapted to urge the viscous product from the receiving means, said drive means including a drive rod extending through at least a portion of said actuating chamber;

an actuating piston adapted to reciprocate between an initial position and an extended position within said actuating chamber, said actuating piston being movable relative to and at least partially surrounding said drive means and having means in contact with said drive means to incrementally move said drive means;

biasing means normally biasing said actuating piston to its initial position;

means for selectively supplying fluid comprising at least one valve assembly and a fluid source, at least one of said valve assemblies having valve means for selectively supplying fluid from said fluid source to a portion of the actuating chamber to increase the pressure within the chamber and drive the actuating piston against its bias from its initial position to its extended position, and means to selectively exhaust said fluid from said portion of the actuating chamber to allow said actuating piston to return from its extended position to its initial position, whereby each activation of said actuating piston incrementally moves said drive means.

27. A fluid operated dispensing device as in claim 7, wherein said means for selectively supplying fluid includes a means for selectively supplying fluid to a separate portion of the actuating chamber to decrease the pressure in the actuating chamber and enable the actuating piston to return from its extended position to its initial position.

* * * * *

UNITED STATES PATENT AND TRADEMARK OFFICE

CERTIFICATE OF CORRECTION

PATENT NO. : 5,181,636

DATED : January 26, 1993

INVENTOR(S) : Anderson, et al.

It is certified that error appears in the above-identified patent and that said Letters Patent is hereby corrected as shown below:

Col. 17, line 33: delete [drive] and insert therefor --driven--

Col. 18, line 11: delete [claim 23] and insert therefor --claim 22--

Col. 18, line 19: delete [25] and insert therefor --22--

Col. 18, line 23: delete [should] and insert therefor --shoulder--

Signed and Sealed this

Eleventh Day of January, 1994

Bruce Lehman

*Attest:*

BRUCE LEHMAN

*Attesting Officer*

*Commissioner of Patents and Trademarks*